United States Patent [19]

Lorenzo et al.

[11] 4,310,235

[45] Jan. 12, 1982

[54] JOB PROGRAMMING

[75] Inventors: Joseph A. Lorenzo, Penfield; Henry E. Mannella, Webster, both of N.Y.

[73] Assignee: Xerox Corporation, Stamford, Conn.

[21] Appl. No.: 129,929

[22] Filed: Mar. 13, 1980

[51] Int. Cl.[3] ..... G03G 15/00

[52] U.S. Cl. ..... 355/6; 355/14 R

[58] Field of Search ..... 355/6, 14 R, 14 C; 235/92 CT, 92 SB, 436; 271/3.1, 4

[56] References Cited

U.S. PATENT DOCUMENTS

| | | | |
|---|---|---|---|
| 3,700,324 | 10/1972 | Hutner et al. | 355/6 |
| 3,917,924 | 11/1975 | Linne | 235/92 SB |
| 4,126,390 | 11/1978 | Connin | 355/14 C |
| 4,202,622 | 5/1980 | Kawatsura | 355/14 C |
| 4,248,528 | 2/1981 | Sahay | 355/6 X |

*Primary Examiner*—Richard L. Moses

*Attorney, Agent, or Firm*—Ronald F. Chapuran

[57] ABSTRACT

A reproduction machine having an operator console, a card reader, and a control with suitable RAM memory. Suitably marked cards are fed to the card reader and stored in RAM memory. A job stream feature permits the operator to place a plurality of different jobs for reproduction into the document handler and the machine will automatically run the different job requirements. The job exception feature allows the machine to be automatically condition to deviate from the normal reproduction run. Features are also programmed at the operator console. However, once a card has been inserted into the reader, the console inputs are inhibited until the sense card requirements are completed or the job is canceled.

6 Claims, 15 Drawing Figures

JOB SET UP / EXCEPTION

| QUANTITY SELECT | | BYTE # |
|---|---|---|
| TENS (BCD) | UNITS (BCD) | 1 |

| QUANTITY SELECT | | |
|---|---|---|
| THOU (BCD) | HUND (BCD | 2 |

1 ST FEATURE BYTE (OVERALL)

| | | | | | | | | |
|---|---|---|---|---|---|---|---|---|
| BIN EXP | — | — | SMPL SET | 74% | 98% | ONE SIDE | AUX TRAY | 3 |

2 ND FEATURE BYTE (OVERALL)

| | | | | | | | | |
|---|---|---|---|---|---|---|---|---|
| STKS | SETS | SNGL FEED | AUTO FEED | (2) — | 65% | IMG SHIFT | TWO SIDE | 4 |

EXCEPTION DOCUMENT #

| | |
|---|---|
| BINARY | 5 |

EXCEPTION FEATURE BYTE

| | | | | | | | | |
|---|---|---|---|---|---|---|---|---|
| | | | ON GLASS | OTHER TRAY | TWO SIDE | ONE SIDE | PAUSE | 6 |

TERMINATE CODE
STORE IN SAME BYTE AS EXC DOC#

| | |
|---|---|
| HEX F F | LAST |

MAX ENTRIES - 120 EXCEPTIONS
OR
24 COMPLETE CARDS

FIG. 7A

MAX ENTRIES – 51 JOBS
OR
12 COMPLETE CARDS +
2 ENTRIES

JOB PROGRAMMING

This invention relates to job programming and in particular to multiple job programming and special interrupts.

To provide automatic control over a plurality of job requirements, systems have been proposed using program control sheets circulated in the machine document handler and decoded to provide control information for a particular job requirement. For example, U.S. Pat. No. 4,157,822 teaches the use of a header card containing control data for a particular stack of documents requiring processing. Stacks of documents with associated header cards are stacked in a recirculating document handler and the required copies for each job are produced in accordance with the control information on the associated header sheet.

In another system, disclosed in copending application U.S. Ser. No. 27,131 (D/79037), coded program sheets are fed through the document handler to control the reproduction sequence for the associated documents. The preprinted operator control sheets are fed with the regular documents past an optical scanner interconnected to the copier controller. The document sheets are then copied in the manner instructed by the preceeding control sheets while the copying of the control sheet itself is automatically inhibited.

A difficulty with systems of this type is that it is usually necessary to redesign the automatic document handler to incorporate the scanning apparatus necessary to read the coded control sheets. It is also necessary to distinguish the code sheets from the originals and also it may be necessary to modify the document transport system to accurately sense the coded sheets, particularly if a wide variety of control features are to be included. In addition, it is often necessary to provide additional catch trays for the documents for those jobs requiring multiple feeding of the originals.

Other prior art systems show that specific copier functions can be controlled by card or tape inserts sensed by a reader/decoder connected to the copier controls. For example, U.S. Pat. No. 3,917,924 demonstrates the use of a coded card for controlling the operation of a reproduction machine and in particular for indicating the number of copies made. Japanese Patent Laid Open No. 53-131048 discloses the use of an information card provided in an automatic document feeding device of a reproduction machine. The information card contains operations such as the number of copies to be provided and the magnification ratio. U.S. Pat. No. 3,912,909 discloses a batch ticket reader for use with bar coded tickets having a complete data message or entry encoded along one edge of the ticket. The reader accepts tickets fed from storage and detects, errors checks, and forwards to a magnetic tape output unit correct data derived from the tickets. U.S. Pat. No. 3,998,329 teaches a card sorting apparatus in which a card is fed from a card hopper and information included on the card is read at a card sensing stage provided along the card feeding path. U.S. Pat. No. 4,065,661 discloses photofinishing apparatus in which data required for producing prints in the photographic printer is entered into the computer via an operator keyboard, and also through a code reader for reading code on a photofinishing envelope. The data is stored in a memory associated with the computer and used to control the photographic printer.

In addition, it should be noted that prior art systems teach the use of coded cards to automatically control the sending and receiving of information to various locations in facsimile systems.

These teachings show that it is known to obtain data through card readers, code readers, or through operator keyboard input. There is no teaching, however, of the applicability to a reproduction machine and in particular no teaching that it can be incorporated into a reproduction machine with minimal adaption of the input and control system of the reproduction machine to provide multiple job programming and special interrupt capability.

It would be desirable, therefore, to provide a reproduction machine that minimizes operator intervention in performing a wide variety of complex reproduction jobs with special interrupts and is not limited by the restraints attendant in feeding control sheets through the automatic document handler.

Accordingly, it is an object of the present invention to provide a new and improved job programming system for a variety of continuous reproduction job requirements and with special interrupts. Further advantages of the present invention will become apparent as the following description proceeds, and the features characterizing the invention will be pointed out with particularity in the claims annexed to and forming a part of this specification.

Briefly, the present invention is concerned with job programming in a reproduction machine having an operator console, a card reader, and a control with suitable RAM memory. Suitably marked cards are fed to the card reader and stored in RAM memory. A job stream feature permits the operator to place a plurality of different jobs for reproduction into the document handler and the machine will automatically run the different job requirements. The job exception feature allows the machine to be automatically conditioned to deviate from the normal reproduction run. Features are also programmed at the operator console. However, once a card has been inserted into the reader, the console inputs are inhibited until the sense card requirements are completed or the job is canceled.

For a better understanding of the present invention, reference may be had to the accompanying drawings wherein the same reference numerals have been applied to like parts and wherein:

FIGS. 7A and 7B are an illustration of the RAM table data bytes for both the job exception and job stream features;

Figure 1:
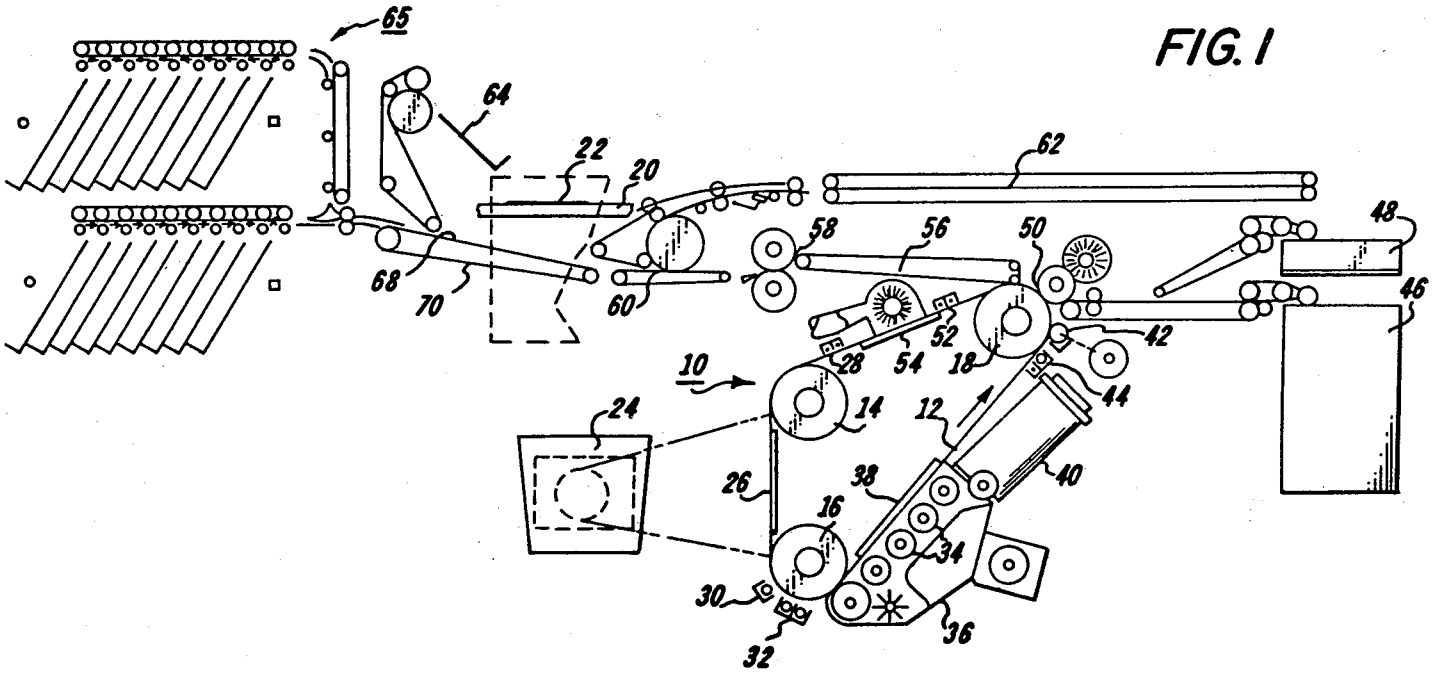
FIG. 1 is an elevational view of a reproduction machine is accordance with the present invention.

With reference to FIG. 1, the reproduction machine shown generally at 10 includes a photoreceptor 12, supported in a generally triangular configuration by rolls 14, 16 and 18. A horizontal, transparent platen 20 provides a surface on which each original 22 is presented for copying. An illumination assembly 24 is provided for projecting an image of each original 22 onto photoreceptor 12 at exposure station 26 to produce an electrostatic latent image of the original 22. To prepare photoreceptor 12 for imaging, it is uniformly charged to a preselected level by charge corotron 28. Erase lamps 30, 32 are provided to prevent development of charged but unwanted image areas.

Magnetic brush rolls 34 are located in a developer housing 36 at developing station 38. The bottom of housing 36 forms a sump containing a supply of developing material comprising toner and carrier particles. The concentration of toner in the developer material is maintained by supplying toner to the developer housing 36 through an orifice in toner container 40.

Copy sheets are fed from either main paper tray 46 or auxiliary paper tray 48 in timed relationship with the image for transfer of the image to the copy sheets at transfer station 50. Residual charges on photoreceptor 12 are removed by discharge lamp and pre-clean corotron 52 and a cleaning brush 54 removes residual developer material from photoreceptor 12.

After passing through transfer station 50, the copy sheets are fed via transport 56 to fuser 58 for permanently fixing the toner to the copy sheets. In a duplex operation, the side 1 copy sheets are directed by deflector 60 to auxiliary tray 48 via return transport 62. Simplex copies or side 2 duplex copies proceed past deflector 60 to either face up tray 64 or sorter 65 depending upon the disposition of deflector 68 relative to transport 70. For a more detailed description of machine 10 reference is made to U.S. Pat. No. 4,062,061 incorporated herein.

Figure 2:
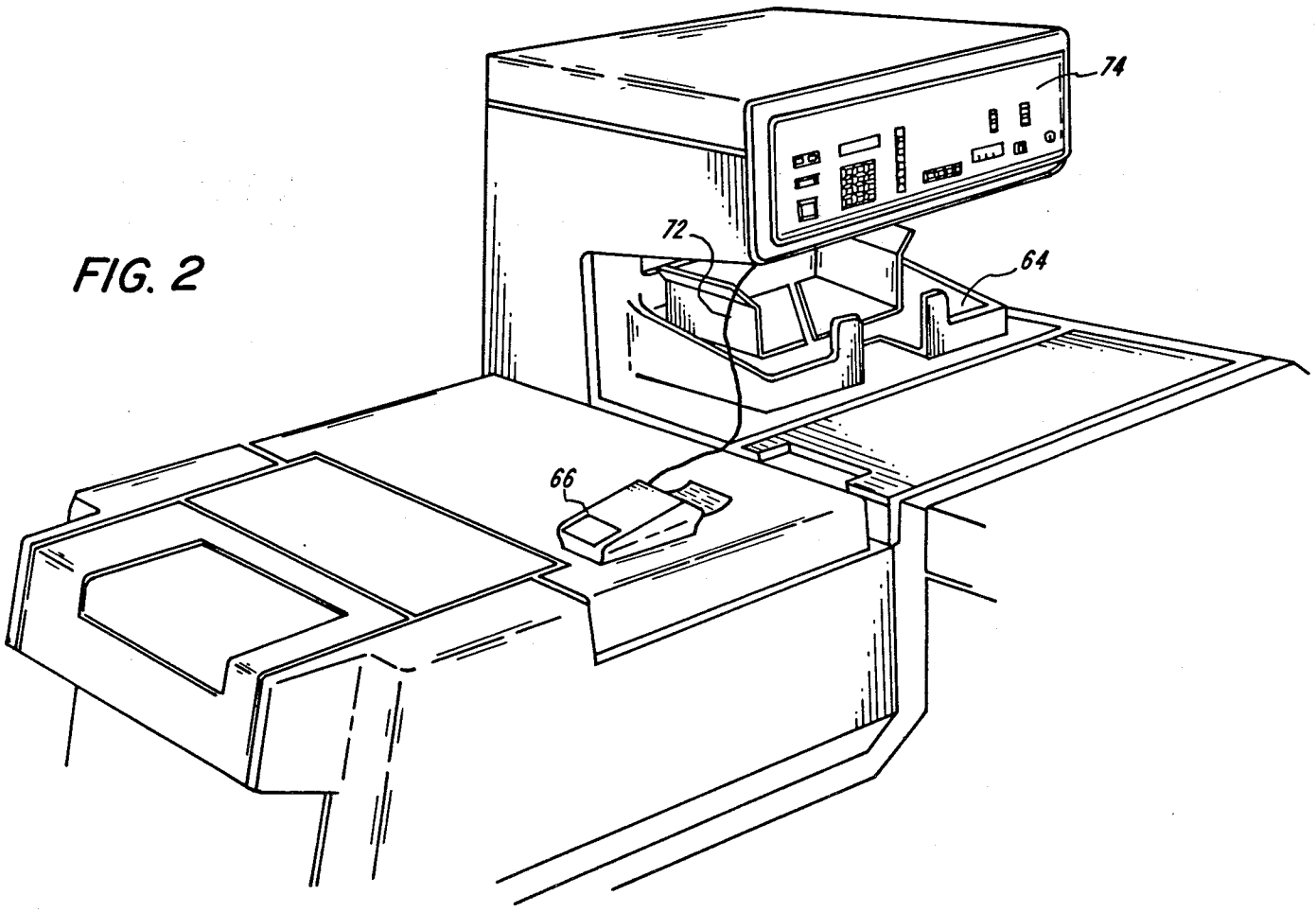
FIG. 2 is an isometric view of the reproduction machine in accordance with the present invention.

Referring now to FIG. 2, in accordance with the present invention, there is shown a suitable card reader 66 such as Hewlett Packard Model No. 9870A. It should be noted, however, that other types of scanning devices for reading indicia provided on cards or paper, can also be used. Cards containing indicia readable by card reader 66 are entered into one end of the card reader and pass beneath infra-red detectors. Reader 66 sends electrical signals indicative of the indicia sensed on the cards to the controller of machine 10 via line 72. The card reader can be utilized as the sole means for programming the reproduction machine or as shown in this embodiment, can be utilized as an optional programming feature to a typical control console 74 found on many reproduction machines.

Figure 3:
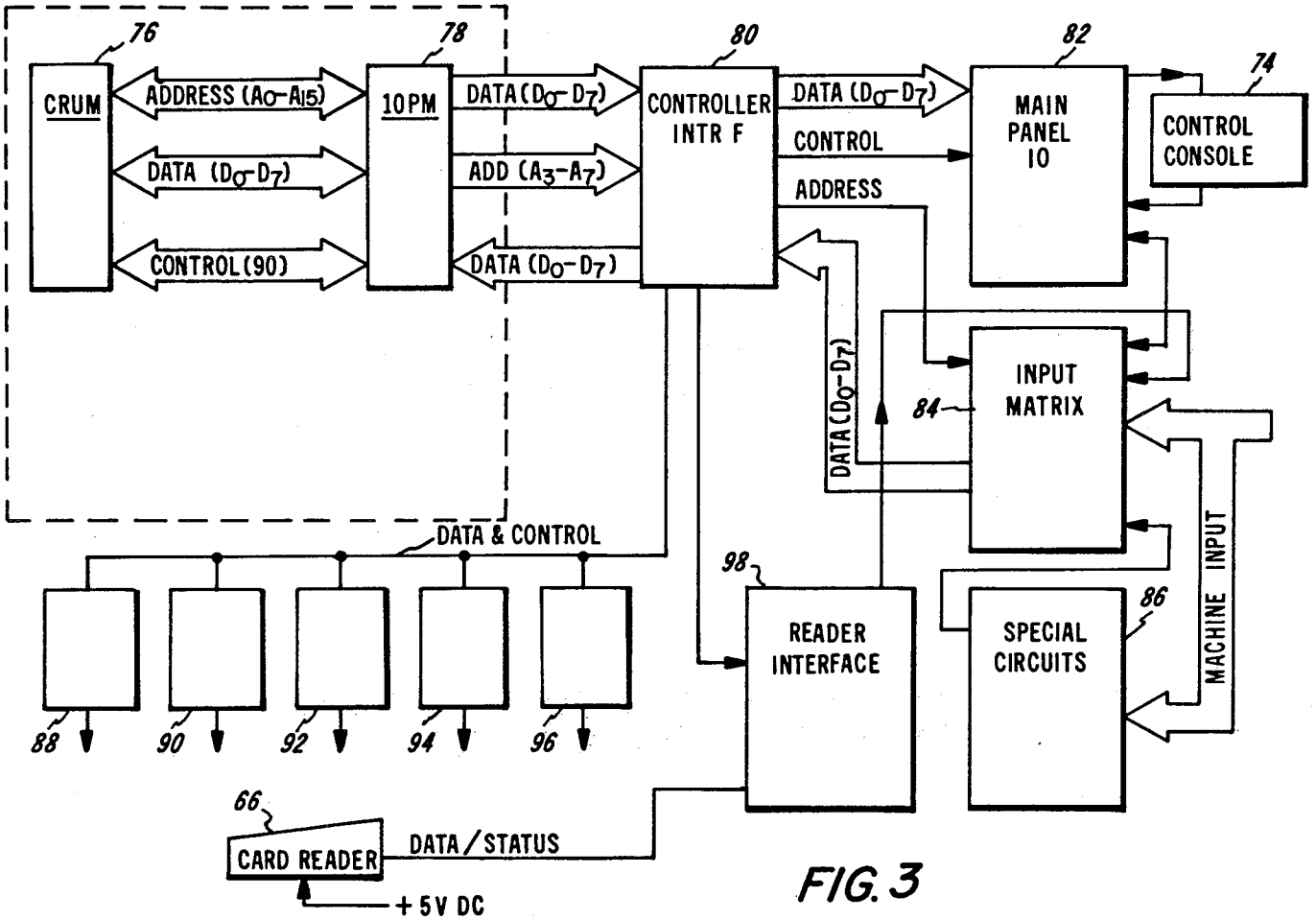
FIG. 3 is a schematic block diagram of the control off the reproduction machine of FIG. 1.

The control of machine 10 as seen in FIG. 3, comprises 6 printed wiring board modules physically located at the control console 74, in particular a central processing unit (CPU) module 76, an input/output processor module 78, a controller interface module 80, a main panel input/output module 82, an input matrix module 84, and a special circuits module 86. Control of the reproduction machine components is through five remote switching boards electrically interconnected to the controller interface module 80. In particular, the automatic document handler board 88, the AC panel board 90, the sorter board 92, the xerographic maintenance module board 94, and the processor board 96 convey control information to the automatic document handler, AC power to motors and powers supplies, control information to the sorter, and monitoring of electrical parameters and control information to various processor components.

With reference to FIG. 2, the control console 74 includes keyboard entries including programming and run control, image reduction, features such as auxiliary paper tray, light original, and colored background, automatic document handler selection, sorter selection, and diagnostic control. These keys activate switches for conveying program information from the control console 74 to the main panel interface module 84. Information is then conveyed from the main panel interface module 82 to the input matrix module 84 and from the input matrix module 84 through the controller interface module 80 and the input/output module 78 to the central processing unit module 76 via the main data bus. The CPU module 76 comprises an Intel 8080 microprocessor, a 48K ROM memory, a 3K RAM memory, and a 1K by 1 bit RAM flag memory, and related circuitry. The program information input from the keyboard at the control console 74 is stored in the 3K RAM memory.

A control program stored in the 48K ROM memory responds to the program information input to the RAM memory to activate the various machine processing components including the processor, the sorter, and the document handler to complete the copy run. The CPU module 76 and the input/output module 78 are interconnected by an address, data and control bus and enclosed within a shield to minimize EMI and RFI noise.

Data and control information is conveyed to the machine processing components via the controller interface module 80. This is the information that is conveyed to operate the various lamps, clutches and relays in the processor. The control console 74 includes status indicators, indicating to the operator the mode of operation selected. The input/output processor module 78 includes direct memory access (DMA) control, priority interrupt control, and input data multiplexer, and a non-volatile read/write memory. The non-volatile memory is electrically connected to a battery to maintain the data if power is lost. The non-volatile memory stores data such as the number of copies on the developer, jam rates, and billing breakpoint information. The input/output processor module 78 interconnects directly with the controller interface module 80 via input and output data buses and an address bus comprising address lines A3 through A7.

All of the input information from the machine components to be processed in the CPU module is entered through the input matrix module 84. Input locations identified with particular address locations are addressed over address lines A3 through A7 extending from the controller interface module 80 to the input matrix module 84. The input data to the input matrix module 84 is directly from machine switches or from machine sensors through analog to digital conversion circuitry located on the special circuits module 86.

In accordance with the present invention as seen in FIG. 3, the card reader 66 conveys information contained on data cards to the input matrix module 84 via the card reader interface 98. The data at the input matrix module 84 is then conveyed to the 3K RAM memory on the CPU module 76 via input/output module 78 under control of the central processing module 76.

Figure 4:
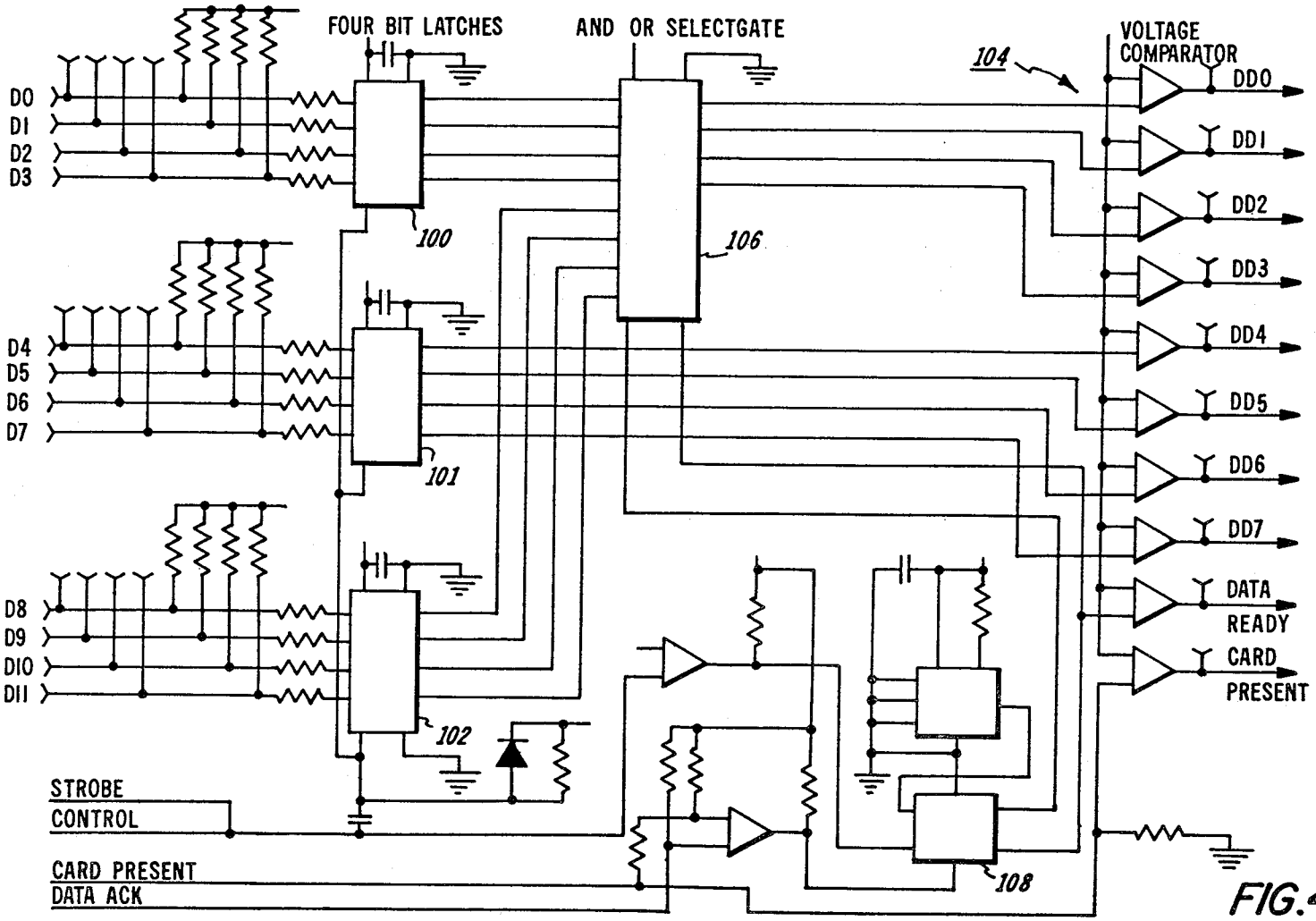
FIG. 4 is a detailed schematic of the interconnection between the card reader and the control of the reproduction machine.

With reference to the card reader interface 88 as seen in FIG. 4, 12 input data lines D0–D11 are connected to latch circuitry comprising three four-bit latches 100, 101 and 102. One of the four bit latches 101 is connected directly to four inputs of a voltage comparator 104 and the remaining eight are connected to an AND/OR select gate 106. The AND/OR select gate 106 under control of a DATA READY flip-flop 108 multiplexes the remaining eight inputs from latches 100 and 102 to an additional four inputs of the voltage comparator 104. The eight outputs of the voltage comparator 104 are connected directly to the input matrix module. Two control lines (data ready and cards preset) are also connected from the voltage comparator to the input matrix module 84.

In operation, marked sense cards are fed to the card reader 66. Each of the marked sense cards contains several rows with 12 columns of information. Each column of each row represents one bit of information. The card reader 66 comprises suitable reading devices, preferably, twelve infra-red light emitting diodes with associated detectors and circuitry for sensing the sense marks on the cards and temporarily storing the indications.

The presence of a card in the card reader 66 generates a card presence signal to condition the DATA READY flip-flop 108 on the card reader interface circuitry and activates the control logic to scan the DATA READY line once every 10 milliseconds. Preferably, the sense cards also contain strobe markings along one edge of the card in the space between each successive rows.

In the sequence of operations, the data is read by the card reader and immediately the strobe markings generate a strobe pulse to activate the DATA READY flip-flop 108 for strobing the data from the temporary buffer in the card reader 66 to the latches on the card reader interface 98. Four bits of information are conveyed directly to the voltage comparator 104 and four conveyed to the voltage comparator 104 through the AND/OR select gate 106. This information is conveyed from the card reader interface 88 through the input matrix module 84 and controller interface module 80 to the input/output processor module 78 and then to the operand register of the Intel 8080 in the CPU module 76. The data in the operand register is formatted and stored in suitable RAM locations. A data acknowledge signal is then conveyed to the DATA READY flip-flop 108 for switching the AND/OR select gate 106 to convey the information on the remaining four lines through the card reader interface 98 to the operand register for formating and storage in RAM.

Figure 5:
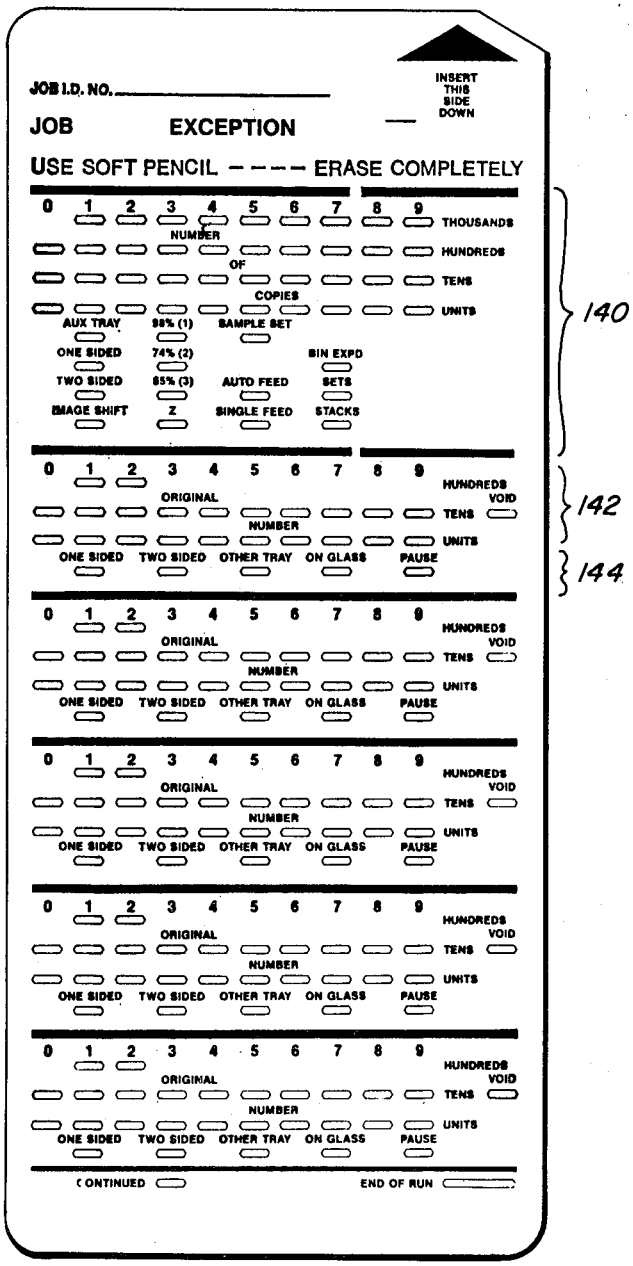
FIG. 5 is an illustration of a marked sense card for a job exception.
Figure 6:
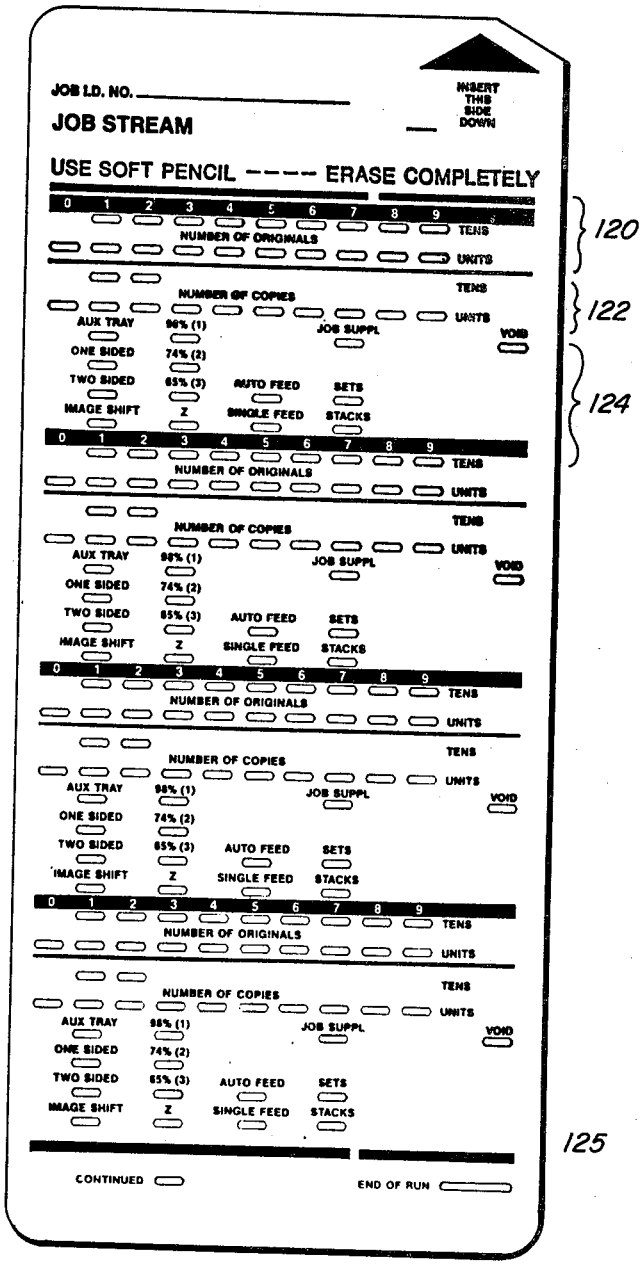
FIG. 6 is an illustration of a marked sense card for job streaming.

In accordance with the present invention, preferred mark sense cards are shown in FIGS. 5 and 6. In particular, an operator is able to preprogram the machine to perform a multiplexity of different tasks or can preprogram the machine to provide an exception to the normal procedure without operator intervention.

Job Programming with the mark/sense cards generally allows programming of the overall job features of:

Quantity—Number of copies required
Two Sided Copy—Image both sides of copy
Second Side Image Shift—Selection of side two image shift
Reduction Mode—Selection of 65% and 98% reduction
Automatic Document Handling—Single or multiple document feed.
Sorter Mode—Selection of sorter mode
Auxiliary Tray—Selection of the auxiliary tray for feeding of paper for simplex, imaged copy.

JOB/EXCEPTION

With reference to FIG. 5, the Job Set Up/Exception card allows programming of features on an exception basis. That is, exceptions which are different than the overall job requirement can be provided. For example, the operator can select:

Simplex/Duplex Copy—Selection of simplex copying within a duplex job and vice versa.
Auto Pause—The machine may be signaled to pause to manually effect other machine features such as reduction, aux tray loading/unloading, and variable density. This is an allowance for manual intervention in the middle of an operation.
Aux Tray—The capability to select the auxiliary tray for copy paper in a simplex mode or main tray if aux tray was selected for overall job.
Sample Sets—The capability of requesting a sample set to be delivered to the sorter.
On Glass—The capability of adding special sheets or documents to the copy sheets by using manual platen access. The same rules apply as with auto pause except the machine will pause after completing the special document to remove it from the platen.

JOB STREAM

With reference to FIG. 6, the Job Stream Card allows the operator to preprogram the machine to automatically run several jobs in the automatic document handler. The resultant copies are output to alternate sorter modules for separation. To continue operation in this mode with more than two jobs, the previously loaded module must be emptied and a maximum of twenty-five (25) copies per job is required or 12 copies with a 12/12 sorter.

By definition, the job stream feature of this invention permits the operator to place a plurality of different jobs for reproduction requirements into the document handler. Each job or reproduction run consists of one or more original documents to be copied a sepecific number of times. The reproduction machine then produces the desired number of copies for each of the originals in each of the job requirements without further manual intervention by the operator. The job supplement feature of the Job Stream card conditions the reproduction machine to deviate from a normal reproduction run similar to the Job Exception procedure.

Figure 7B:
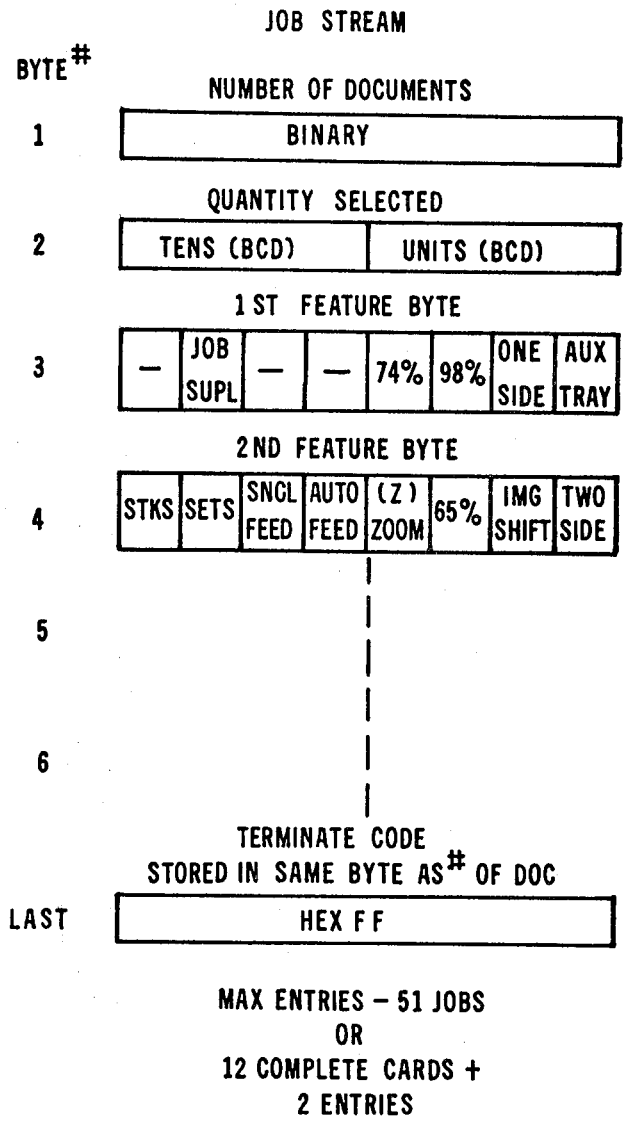

A bar at the top of the card identifies a job stream or a job set up exception operation. Depending upon the particular operation, the information from the input cards is formatted and stored in RAM memory as shown in FIG. 7. In a job stream operation, the sense card information is formatted and stored in successive random access memory locations in the following sequence. In the first location, a binary representation of the number of documents for the first job is stored and the quantity selected for the first job is stored in a second memory location in binary coded decimal format.

The next two memory locations contain identifications of the features selected. In particular, in the first location, bit 6 identifies job supplement, bit 3 identifies 74 percent reduction, bit 2, 98 percent reduction, bit 1, simplex and bit 0, the auxiliary tray. In the second location, bit 7 identifies stack mode, bit 6, set mode, bit 5, single feed, bit 4, auto feed, bit 3, zoom lens, bit 2, 65 percent reduction, bit 1, image shift and bit 0, duplex copying. Information is then formatted in the next memory locations for job two, specifically identifying the number of documents and quantity selected and the specific features.

In the job set up/exception, successive memory locations store manifestations of the requirement indicated on the card. The first two memory locations store the manifestations of the quantity selected, the second two memory locations store manifestations of overall features, and the next two locations store manifestations of the document number and particular exception.

In both job stream and job set-up exception, a terminate code ends the operation. It should be understood that suitable counters can be used rather than RAM locations to count the documents to be copied.

Features can be programmed either by selecting the appropriate buttons on the control console or by inserting a card into the reader. However, once the card has been inserted into the reader, the inputs from console are inhibited until the copy run has been completed or if the job is canceled.

Figure 8:
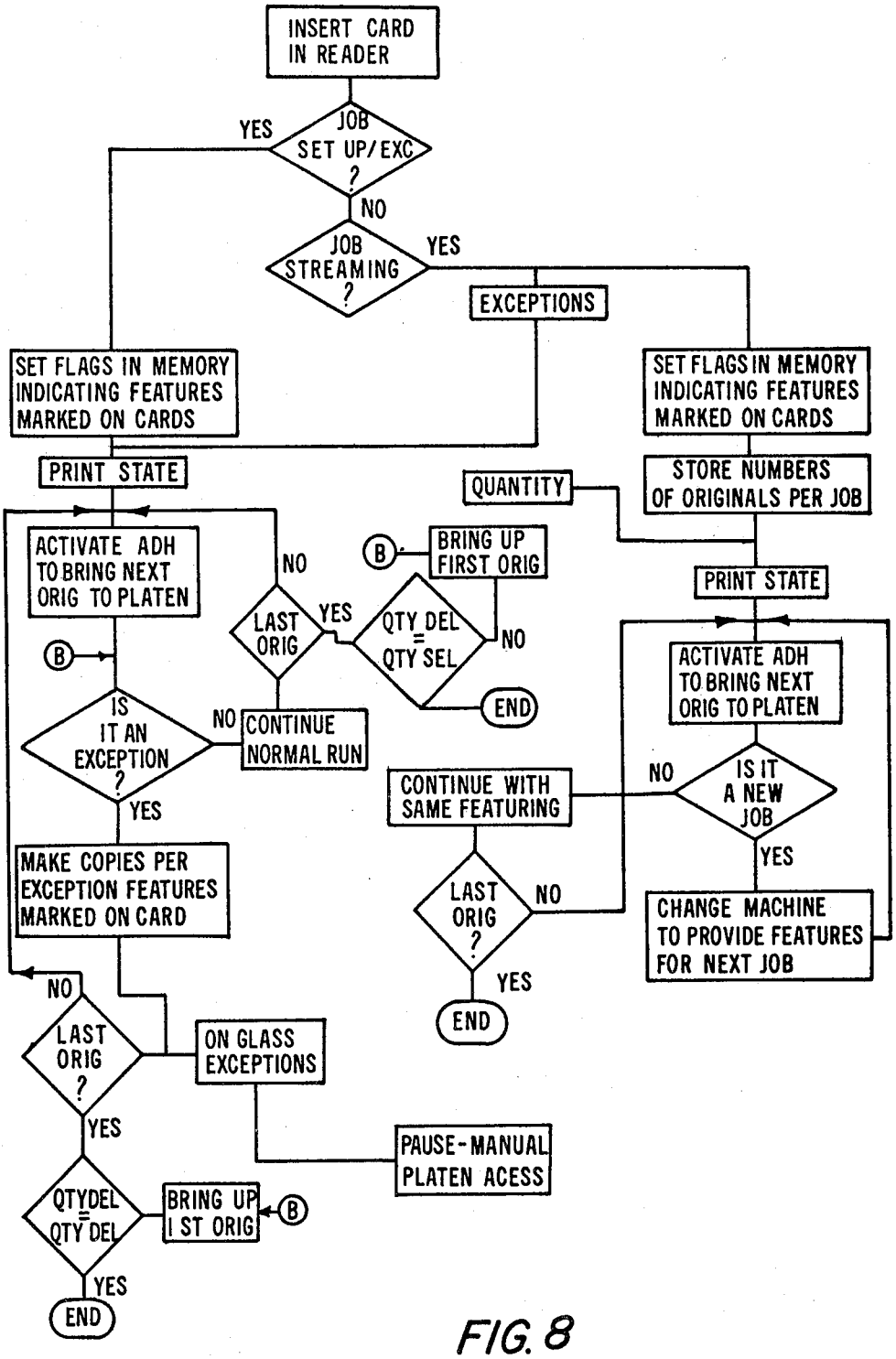
FIG. 8 is a flow chart illustrating the job exception and job streaming sequence.

The flow chart set out in FIG. 8 sets out the sequence of events for programming the machine via card reader 66. Each of the cards different indicia (the configuration of the horizontal bars on the cards) indicating whether the card is associated with the job stream or the job set up/exception features. This indicia is read by reader 66 and a signal is conveyed to the controller indicating the type of card. Reader 66 then progresses to read each line of data from the card and store that information into RAM memory. The controller, in particular CPU 76, includes logic to check that incompatible features have not been selected on the card for the particular copy run. For example, the selection of the auxiliary tray for duplex copying would be incompatible and an error would be indicated by lighting an appropriate light (not shown) on the control console 74.

More than one card can be accepted for each of the job stream or job set up/exception features. Once the last card has been entered, as indicated by marking the appropriate box on the card, the controller enters into a verifying mode in which the compatibility of the features marked by each card is tested. By the intermittent pressing of a display select button shown in FIG. 2 on console 74, the different machine features selected can be sequentially displayed by lighting appropriate indicator lights (not shown) on console 74.

By pressing start print button on operator console 74, all of the features selected for the first portion of the copy run are programmed by the controller. This requires setting particular bits or flags in portions of the memory which indicate that the corresponding feature has been selected. After the machine has been conditioned to perform these features, a ready light is activated. By pressing start print button again, the machine begins its copy run.

JOB STREAM

Figure 9:
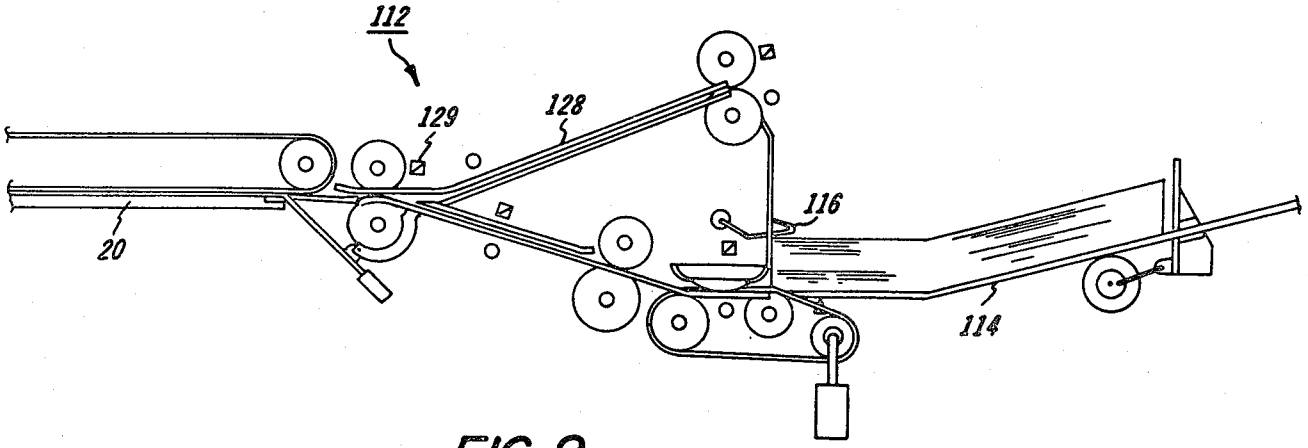
FIG. 9 is a detailed elevational view of the document handler of the reproduction machine.

In accordance with the job stream feature of this invention the operator places a plurality of different document sets (each set with different requirements) into the document handler 112 (see FIG. 9). Copies are then continually produced for each set without further manual intervention. All of the different document sets are stacked together and placed face down in the input tray 114 of the document handler 112, so that the first document of the first set is at the bottom of tray 114. A rotatable separator or bail bar 116 is placed on the last document of the last required set.

Referring now to FIG. 6, the operator marks the appropriate boxes on card portion 120 indicating the number of originals in the first document set. On card portion 122, the operator indictes the number of copies desired for the first set. On portion 124, the operator indicates the features desired for the first set. Programmable features include feeding copy sheets from the auxiliary tray 48 (AUX TRAY) instead of main tray 46; simplex copies (ONE SIDED); duplex copies (TWO SIDED); offsetting the side 2 image on duplex copies to allow for stapling (IMAGE SHIFT); 98 percent, 74 percent and 65 percent reduction modes; continuously feeding the originals to platen 20 by the document handler 112 (AUTO FEED); bringing only one document to platen 20 by document handler 112 (SINGLE FEED); collating the copies in the sorter 65 (SETS); and segregating all copies from a particular original in one bin in the sorter 65 (STACKS). The operator then repeats the selection for the remainder of the document sets. If there are more sets, the box marked "continued" at the bottom 125 of the card is checked and the same procedure is followed for the next cards. Otherwise, the "end of run" box is marked.

Figure 10:
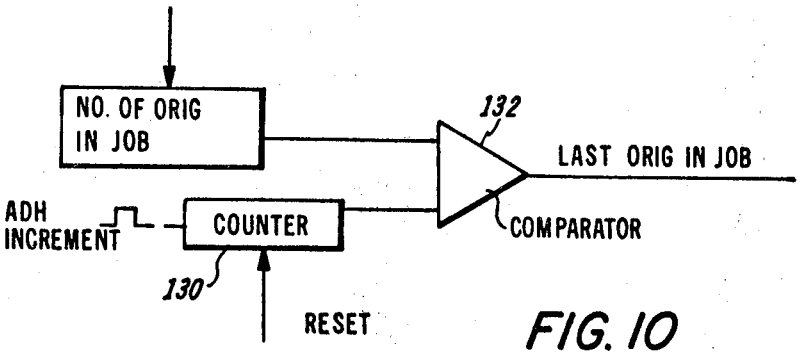
FIG. 10 is a circuit diagram of portions of the logic circuitry used in the job stream feature of the present invention.
Figure 11:
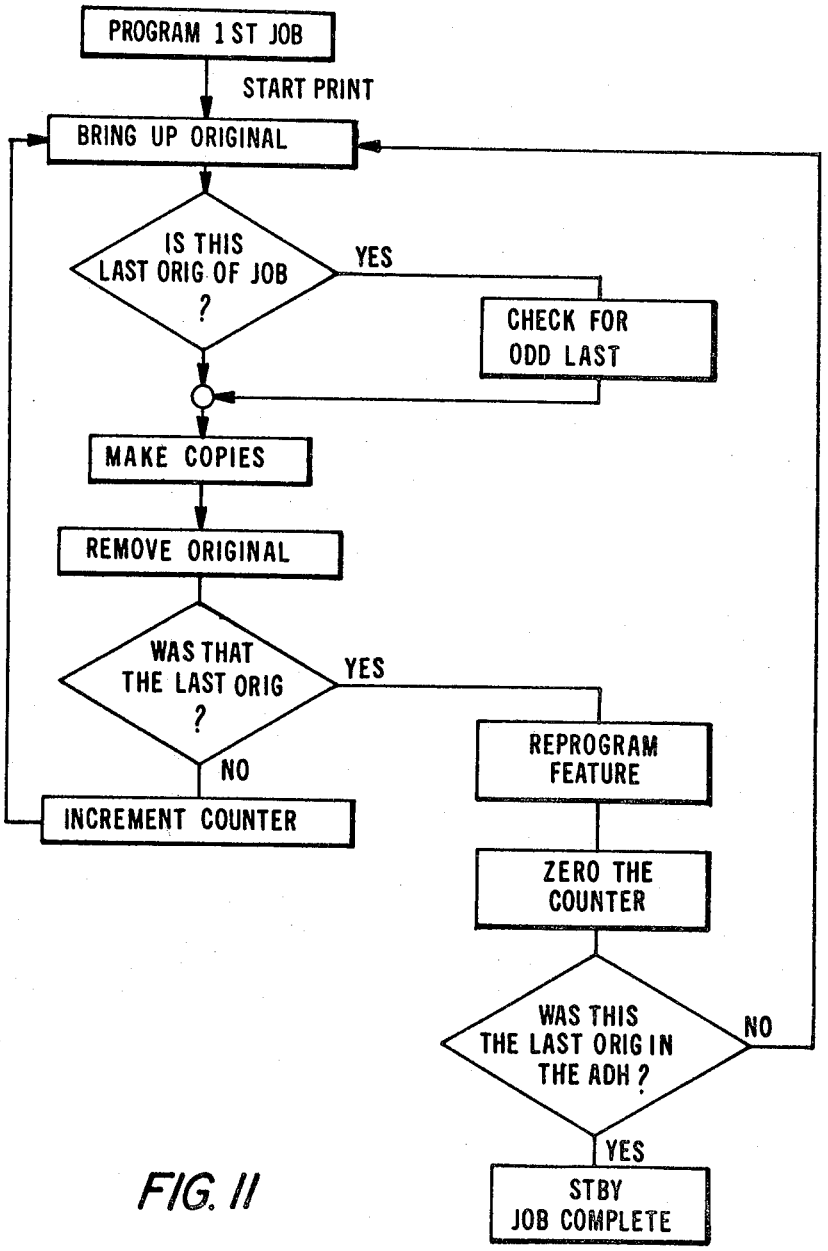
FIG. 11 is a more detailed flow chart of the sequence of events for the job stream feature.

Upon activation of start print button, document handler 112 brings the first set onto platen 20 and the selected number of copies are produced according to the first job features selected. The original is then removed from platen 20 via return transport 128 and placed on top of bail bar 116 in the input tray 114. Every time an original is removed from platen 20, sensor 129 provides a signal to increment counter 130 shown in FIG. 10. This counter can be of conventional hardware design or as in the preferred embodiment can be a counter programmed by software using a suitable memory location. The content of counter 130 is continually referenced by comparator 132 to the number of originals in the set, this number being stored in a suitable memory location memory. For example, assuming eight originals in the first set, counter 130 is incremented every time an original is removed from platen 20. When the eighth original is registered by counter 130, the output of comparator 132 provides a signal indicative that that was the last original in the set. This sequence is illustrated in FIG. 11.

Figure 12:
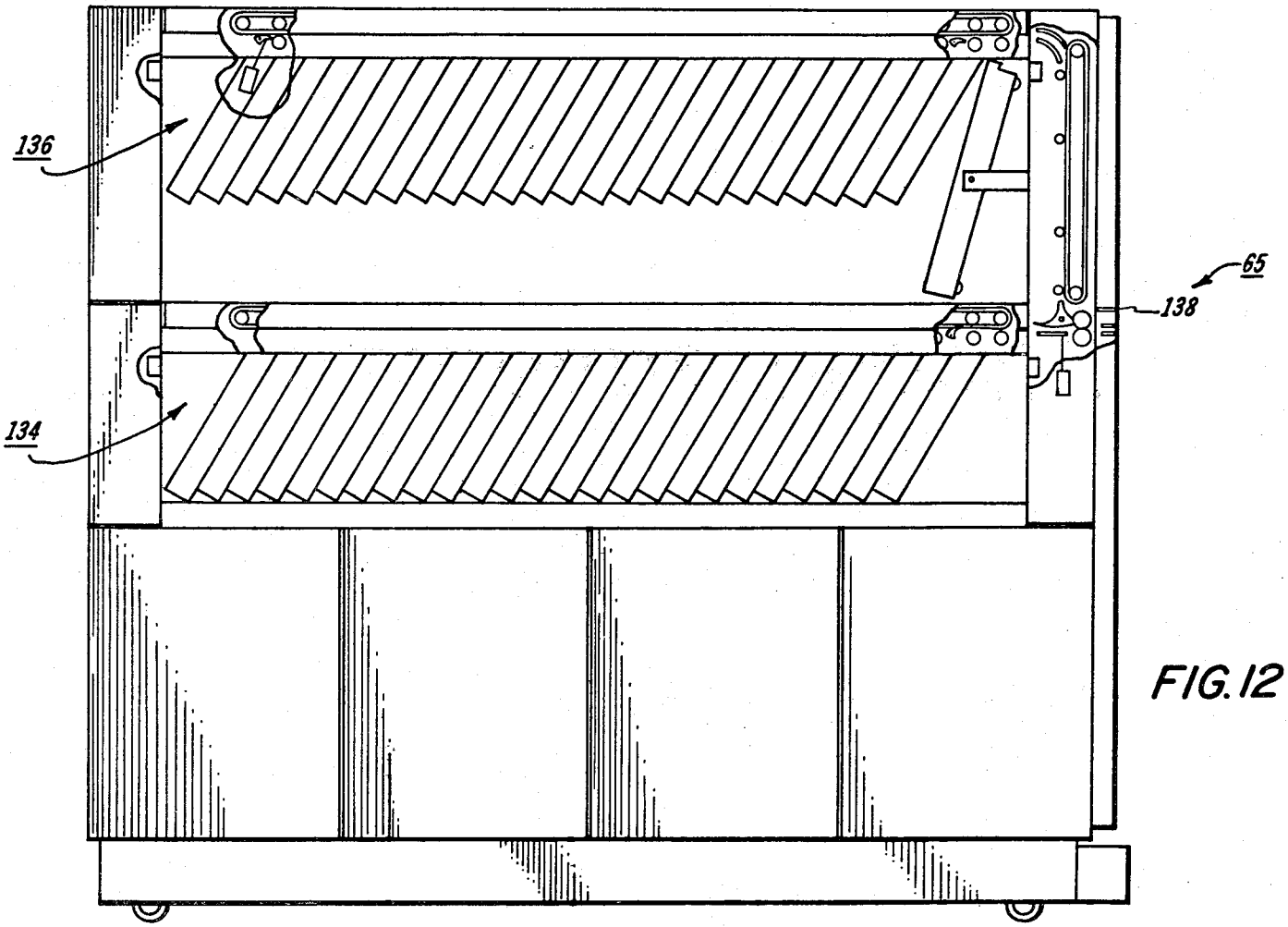
FIG. 12 is an illustration of a sorter to be used in the reproduction machine of the present invention.

The copies of the first document set are placed in lower module 134 of sorter 65 (FIG. 12), the copies of the second document set in upper module 136, and the copies of the next document set in lower module 134 (provided it has been emptied). Deflector 138 is deactivated to direct the copies from the second document set into upper module 136. Accordingly, the operator can unload the lower module 134 while the copies from the second document set are being collated in the upper module 136. Copies of the third document set are then placed into lower module 134. This process continues for as many document sets required.

JOB SET UP/EXCEPTION

In accordance with the job set up/exception feature of this invention, the machine is automatically conditioned to provide copies from a particular original of a document set requiring features different from those required for the remainder of the documents of the sets.

Referring now to FIG. 5, on card portion 140, the operator marks the appropriate boxes to select the number of copies and machine features for the normal copy run. On card portion 142, the operator marks the number of the first original requiring an exception from the normal copy run. On card portion 144, the operator selects the different or exceptional features for that particular original, deviating from those selected for the normal copy run on portion 140. Similarly, on the remaining card portions, exceptions can be indicated for other documents. (Exceptions do not have to be in numerical order.)

Figure 13:
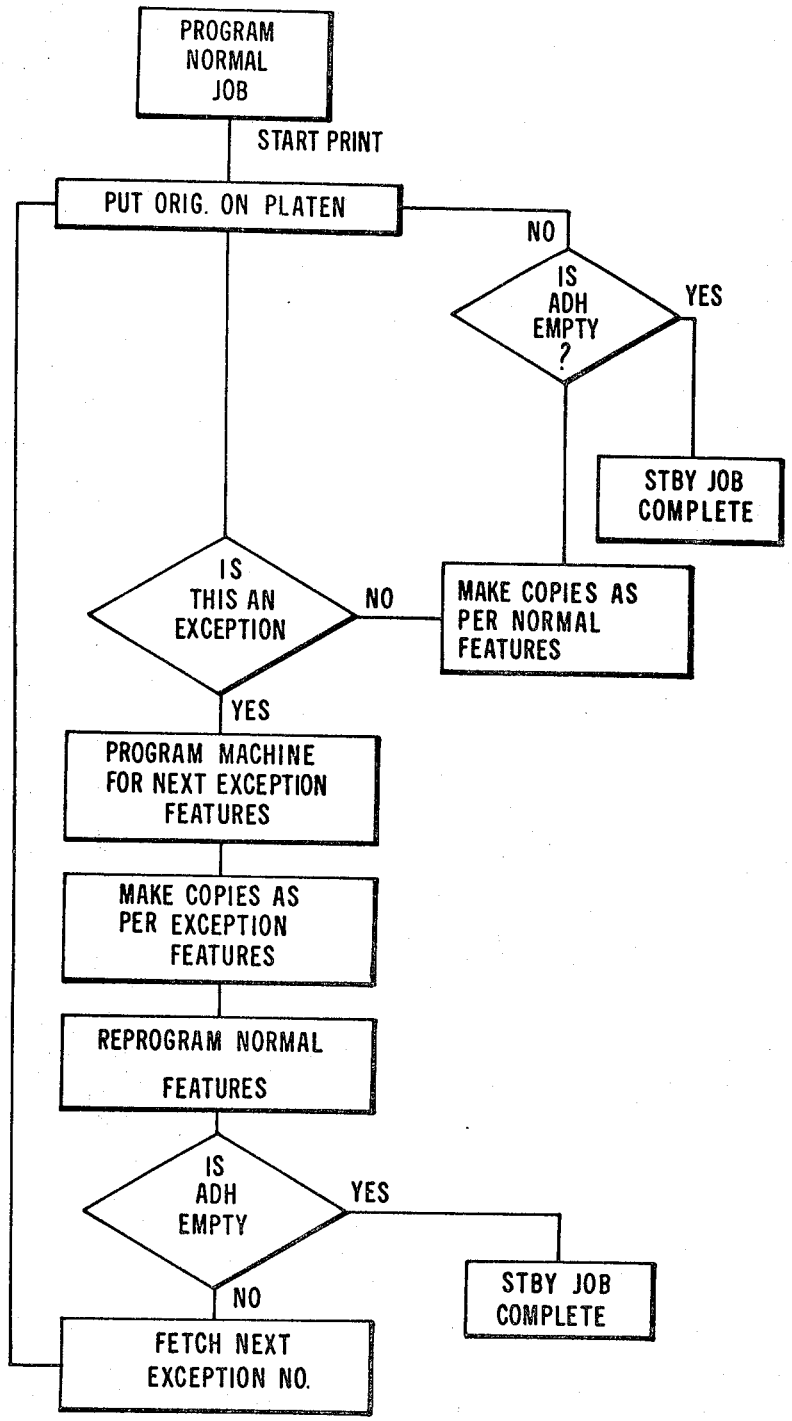
FIG. 13 is a more detailed flow chart of the sequence of events for the job exception feature.

As one example, assume that the TWO SIDED, AUTO FEED, and SET features have been selected on card portion 140 for the normal copy run. Assume further that there are eight originals in the set to be duplex copied, but that it is desired for original number 3 to be only a simplex copy. The operator first marks the approxiate boxes in portion 140, 142 and 144. The sequence is illustrated in FIG. 13. Upon pressing the start print button, the document handler 112 is activated to bring the first original onto platen 20. Since this original is not an exception, the machine makes copies as per the normal features selected. The controller checks that the ADH 112 is not empty and then brings the next original onto platen 20.

Figure 14:
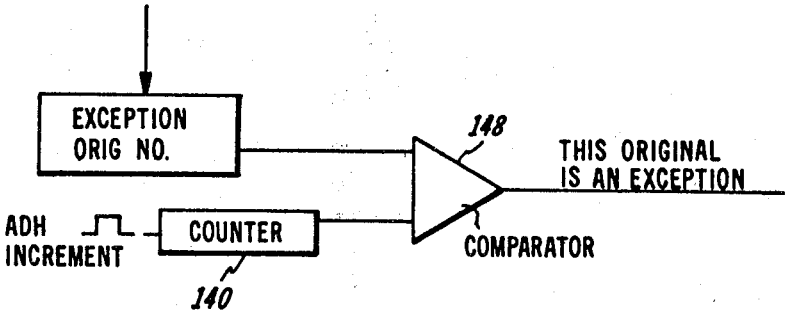
FIG. 14 is a circuit diagram of portions of the logic circuitry used in the job exception feature of the present invention.

Referring to FIG. 14, as each original is removed from platen 20, sensor 129 provides an output signal to increment counter 146. The contents of the counter 146 are continually being monitored by comparator 148 with the next exception original number supplied from a suitable memory location. When counter 146 indicates that the next original to be presented to the machine has been designated as an exceptional original, the controller conditions the machine for making copies according to the exception features as for that particular document. After the requisite number of copies are produced, the controller reconditions the machine for the normal features originally selected. The next exception original number is then fetched from a suitable memory location for input into comparator 148. The next original will then be placed on platen 20 and copies therefrom produced according to the normal features selected for the copy run, assuming that there is no coincidence detected by a comparator 148 indicating that this original is also an exception. The above procedure continues until the document set is completed.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A reproduction machine conditioned to automatically deviate from a first operation, said machine including a plurality of components controlled by a programmable controller, said machine comprising:

a card reader for reading indicia on a card setting out the features selected for the first operation, the number of the original requiring deviation and the deviations required;

said controller normally operating said machine components according to said first operation;

counter means for counting the number of originals presented to the machine for copying;

means for comparing said counter content with the number of the original requiring deviation; and means for automatically reconditioning the machine to make copies according to the deviation required if said comparison indicates that the next original is the original for which a deviation is required.

2. A reproduction machine for providing a set of reproductions of a document set, the reproductions generally having first features, including the means to select one of the document set to provide second features for the reproductions of said one of the document set comprising a sensor determining first features generally selected for the document set and also for determining second features for at least one of the document set;

means for selecting said at least one document from said document set; and means for automatically conditioning the machine to make reproductions according to the second features determined for said at least one document.

3. The machine of claim 2 wherein the sensor is a card reader sensing indicia on a card.

4. The machine of claim 2 wherein the means for selecting comprising a counter for identifying the document requiring the different features.

5. The machine of claim 2 including means to continue making reproductions according to the first features upon completion of reproductions of the second features for selected documents.

6. A reproduction machine operating on a set of documents for generally providing reproductions of the set of documents with a first set of features and reproductions of a selected one of the set of documents with a second set of features different from the first set of features comprising:

a card reader for determining the first and second features;

means for storing information on said features; and means for conditioning the machine to make reproductions according to the first features selected and the second features selected.

* * * * *